US006579458B2

(12) United States Patent
Mickelat et al.

(10) Patent No.: US 6,579,458 B2
(45) Date of Patent: Jun. 17, 2003

(54) SCREENING DEVICE

(75) Inventors: Thomas Mickelat, Nittenau (DE); Maximilian Baier, Sinzing/Eilsbrunn (DE); Hubert Gassmann, Regenstauf (DE)

(73) Assignee: Heinrich Fiedler GmbH & Co. KG, Regensburg (DE)

( * ) Notice: Subject to any disclaimer, the term of this patent is extended or adjusted under 35 U.S.C. 154(b) by 0 days.

(21) Appl. No.: 09/808,400

(22) Filed: Mar. 14, 2001

(65) Prior Publication Data

US 2001/0032816 A1 Oct. 25, 2001

Related U.S. Application Data

(63) Continuation of application No. PCT/EP99/06801, filed on Sep. 14, 1999.

(30) Foreign Application Priority Data

Sep. 14, 1998 (DE) ..... 198 42 042

(51) Int. Cl.[7] ..... B01D 33/067

(52) U.S. Cl. ..... 210/360.1; 210/402; 210/404; 210/484; 210/485; 210/492; 210/494.2; 210/497.01; 210/497.3; 210/232; 29/896.62

(58) Field of Search ..... 210/402, 404, 210/497.01, 494.2, 494.1, 497.1, 498–499, 483–485, 488, 489, 360.1, 380.1, 445, 455, 361, 492, 360.2, 497.3, 232; 29/896.6, 896.61, 896.62

(56) References Cited

U.S. PATENT DOCUMENTS 1,855,904 A * 4/1932 Brown et al.
2,055,251 A * 9/1936 Duvall
2,134,703 A * 11/1938 Cobb
2,204,928 A * 6/1940 Culver
2,259,235 A * 10/1941 Weiss
2,306,074 A * 12/1942 Meyer
2,321,207 A * 6/1943 Howe
2,352,340 A * 6/1944 Oswald
2,534,161 A * 12/1950 Collins
2,567,266 A * 9/1951 Young
2,710,693 A * 6/1955 Manley et al.
2,724,507 A * 11/1955 Cataldo (List continued on next page.)

FOREIGN PATENT DOCUMENTS

DE 39 42 484 A 6/1991
DE 3942484 * 6/1991
DE 196 51 643 A 6/1998
EP 0 471 195 A 2/1992
EP 0 724 037 A2 7/1996
EP 0 738 531 A 10/1996

OTHER PUBLICATIONS

J & L Fiber Services BelWave Screen Cylinder, Waukesna, USA, 1981.

J & L Fiber Services, RSC Screen Cylinder, Waukesna, USA, 1981.

*Primary Examiner*—W. L. Walker
*Assistant Examiner*—Marianne Ocampo
(74) *Attorney, Agent, or Firm*—Henry M. Feiereisen

(57) ABSTRACT

A screening device includes a screening element connected to a reinforcing element by a frictionally engaging clamping connection. Spacers located between the screening element and the reinforcing element provide a radial clearance therebetween. The screening element can be replaced when worn out, while the reinforcing element and associated parts can be reused with a new screening device. For this purpose, the screening element can be detached from the reinforcing element, which provides the actual support function, as a single unit by way of the frictionally engaging clamping connection. The clamping connection can be implemented by way of wedges or a conical seat.

34 Claims, 9 Drawing Sheets

U.S. PATENT DOCUMENTS 3,036,354 A * 5/1962 De Bie
3,954,622 A * 5/1976 Kus
3,955,754 A * 5/1976 Schaper ..... 127/19
4,401,564 A * 8/1983 Epper et al.
4,954,249 A * 9/1990 Gero et al.
5,023,986 A 6/1991 Gero et al.
5,200,072 A * 4/1993 Frejborg et al.

* cited by examiner

SCREENING DEVICE

CROSS-REFERENCES TO RELATED APPLICATIONS

This application is a continuation of prior filed copending PCT International application no. PCT/EP99/06801, filed Sep. 14, 1999.

This application claims the priority of German Patent Application Ser. No. 198 42 042.0, filed Sep. 14, 1998, the subject matter of which is incorporated herein by reference.

BACKGROUND OF THE INVENTION

The present invention relates to a screening device for screening fiber suspensions, and more particularly, to a screening device which can be applied in the paper industry, for example with pressurized sorters.

Screening devices typically include a substantially cylindrical screening element with a screening surface in the form of a slotted hole screen mat or a screen plate provided with drilled or milled/sawn screening slots. Such screening device has to withstand high static and dynamic loads, particularly in sorter applications. Hence, a spacer element is typically associated with the cylindrical screening element. The cylindrical screening element with the spacer element is supported on a reinforcing element with a radial clearance. The reinforcing element can have the form of, for example, a reinforcing jacket. Terminal elements, for example, in the form of end rings, can be provided on the axial ends of the screening device to aid in positioning of the screening device. In typical arrangements, the respective terminal element is welded to the reinforcing element and the screening element, whereby the screening element is assembled first and the reinforcing element is subsequently positioned from the outside over the screening element and thereafter secured. Finally, the ring-shaped terminal elements are connected with the cylindrical screening element along the circumference of the reinforcing element. The welding seams of the weld connection are accessible only from one side. The high static and dynamic loads can introduce notch stress, so that the durability of such screening device depends strongly on the integrity of the weld connection.

In typical applications, the screening element in particular is subjected to severe wear, with the reinforcing element having a much longer service life. Because the manufacture of the screening device requires a weld connection between the screening element with the spacer element and the reinforcing element, the entire screening device has to be exchanged when the screening element wears out, which is expensive and complex.

European Pat. No. EP-0 471 195 A1 as well as U.S. Pat. No. 5,200,072 discloses screen plates, screen cylinders and methods for manufacturing the same. The cylindrical screening device is designed so that the screening element and the screening units forming the screening element are releaseably and interchangeably connected to a support cylinder that forms the reinforcing element. The manufacturing cost and the manufacturing time is reduced in that only a worn-out screening element has to be replaced, whereas the reinforcing element, in particular the support cylinder, can be reused. The releaseable connection between the screening element and the jacket-shaped reinforcing element is formed by making the outside diameter of the screening element slightly greater than the inside diameter of the support cylinder. The screening element and the reinforcing element are non-positively secured to one another by a temperature-dependent shrink-on process. This connection can optionally be secured by an additional step, for example, by welding, riveting, with screws, adhesives, solder and the like.

U.S. Pat. Nos. 4,954,249 and 5,023,986 disclose a modular screen basket with several small ring-shaped cylindrical screening elements. The individual cylindrical screening modules are interchangeable and are positively connected with reinforcing rings via notches. The axial end rings are tensioned with respect to one another by a plurality of tension rods. The axial tension rods are simultaneously guided through bores provided in the reinforcing rings.

European Pat. No. EP-A-0 724 037 discloses a screen basket wherein the profile rods are positively connected with reinforcing rings.

German Pat. No. DE 39 42 484 A1 describes a sorter with a screen basket which is supported on the sorter housing by support rings. The design of the support structure is quite complex and the axially spaced apart support locations can absorb only radial forces, but no torsion forces. Since the sorter housing provides the main support function, it requires modifications to accommodate different types of screen baskets or screening elements, since there are no additional reinforcing elements aside from the sorter housing that can be adapted to support the screen basket.

J & L Fiber Services, Inc., Waukesma, USA, supplies screening cylinders, wherein a plurality of short rod-shaped elements is positively located in grooves of reinforcing rings and fixed in position by tension rods, which is time-consuming and expensive. The entire screening cylinder has to be disassembled to exchange any damaged and worn elements.

It would therefore be desirable to provide a screening device of simple design which can be applied, in particular, with fiber suspensions in the paper industry, and which permits an economical and cost-effective reuse of those elements of the screening device that are not severely worn, such as the reinforcing element. In addition, the screening element and the reinforcing element should be reliably connected to one another so as to support both dynamic and static loads.

SUMMARY OF THE INVENTION

According to one aspect of the invention, a screening device, in particular for fiber suspensions in the paper industry, is provided which has a substantially cylindrical screening element forming a screening surface, with the screening element being radially supported on a reinforcing element by spacers with clearance therebetween. The screening element can be interchanged as one unit and is non-positively secured to the reinforcing element by a frictionally engaging clamping connection.

In this way, the screening element forming the screening surface can be released from the reinforcing element when the screening element is consumed. The reinforcing element, on the other hand, can be reused with the screening device after insertion of a new screening element. The design of the screening device according to the invention is based on the observation that the actual screening and/or sorting function is mainly performed by the screening element with the screening surface, possibly in cooperation with the spacer elements, whereas the reinforcing element provides the actual support for the screening element and facilitates insertion of the screening device in the respective machine. The clamping connection between the screening element and the spacer elements, on one hand, and the reinforcing element, on the other hand, distributes the clamping force uniformly over the entire circumference of the screening device and the reinforcing device. The clamping forces of the frictionally engaging clamping connection alone can reliably secure the screening element against rotation with respect to the reinforcing element. Since this connection is releaseable, the screening device can be removed from the reinforcing device without damaging the reinforcing device. Accordingly, the invention permits the reinforcing element to be reused repeatedly, while the screening element itself, which is subject to wear even if the screening device is used as intended, can be exchanged as an entire unit.

Advantageously, the entire screening device can be pre-fabricated and unit exchanged as a single unit. In particular, the reinforcing element, which can be fabricated separately and independently of the screening device, provides the actual support function and ensures the proper fit of the screening device to the machine, such as a sorter. By separating the screening and support functions and/or the fit, the respective components of the screening device, i.e., the screening element and/or the reinforcing element, can be designed and constructed to take into account the desired properties, without requiring tradeoffs for the purpose of a matching these elements.

The screening device of the invention therefore obviates the rigid connection between materials, such as a weld connection between the reinforcing element and the screening element. By making those screening elements that tend to wear out sooner interchangeable and by reusing the reinforcing element, the screening device of the invention uses less material. Moreover, the screening device can be procured cost-effectively and the components that are not consumed, can be reused. The screening devices according to the invention can also be reconditioned and returned to service much more quickly, because not all the fabrication steps that are required for the initial production of the screening device have to be executed, so that some of these steps can be omitted. The screening device of the invention can be modular, facilitating its fabrication and stocking. For example, screening elements as well as associated reinforcing elements can be pre-fabricated in standard sizes and assembled application-specific to a screening device. The screening device of the invention also allows cost-effective retooling, if a screening device of a different design should be used, for example, to improve efficiency, even if the screening device itself is not yet worn out and is still be usable.

Another aspect of the invention is the particular design of the releaseable connection between the actual screening element and the reinforcing element. The frictionally engaging clamping connection provided by the invention secures the screening element with the substantially cylindrical screening surface reliably and firmly along the entire circumference of the reinforcing device.

According to another feature of the present invention, the clamping connection secures the screening element through frictional engagement, preferably through a wedge action on the reinforcing element. For this purpose, non-positive clamping devices and/or clamping elements are employed, preferably with a wedge action for providing the non-positive connection.

Alternatively, the clamping connection can be implemented so that the screening element is secured on the reinforcing element through a conical seating action in the axial direction. With this arrangement, the outside surfaces of the spacer elements of the screening elements with the screening surface, which have a conical shape in the axial direction, cooperate with a corresponding conically shaped reinforcing element to provide a non-positive connection. In this arrangement, the clamping connection between the screening elements with spacer elements and the reinforcing element is implemented as an axial conical press fit. In other words, this screening element forms a screening insert with a substantially cylindrical inside surface as the screening surface and a conically shaped axial outside surface formed by spacer elements. The screening device is formed by inserting the screening insert in a corresponding conical reinforcing element, for example a reinforcing jacket, extending in the axial direction. The conically engaging seating surfaces provide the clamping connection between the screening device and screening insert, respectively, and the reinforcing device.

Advantageously, the clamping connection can include clamping elements which are radially displaceable towards the reinforcing element for forming the clamping connection. In this way, the type, number and arrangement of the clamping element that provide the clamping connection can be selected to conform with the specific requirements, such as the size and application and the like.

According to another feature of the present invention, the clamping connection may include clamping elements with an I-shaped cross-section. One of the transverse sides contacts the screening device, with the other transverse side contacting to the spacer elements. Preferably, such clamping element can be in the form of a strip extending in the axial direction of the screening device. The screening element with the screening surface and the spacer elements are here tensioned with respect to the reinforcing element such that the screening sections of the screening surface with the associated spacer elements are spread apart in the circumferential direction by the clamping element and tensioned against the reinforcing element. By forming the clamping element as a strip extending in the axial direction, the clamping strip can be driven in the axial direction from one end face to the other end face of the screening element between the screening sections of the screening element, thereby spreading and tensioning the screening element against the reinforcing element.

According to another feature of the present invention, the clamping elements may be configured in the form of wedge elements with a radial tensioning direction to establish the clamping connection. Such wedge-operated tensioning connection can be formed through respective cooperating wedge and spacer elements by forming mutually cooperating inclined wedge tensioning surfaces. The respective wedge elements can be implemented in many different ways.

According to another feature of the present invention, the clamping element may have be T-shaped configuration, with the transverse side of the "T" contacting the screening device. Advantageously, the T-shaped clamping element of this embodiment can be in the form of a rail or strip extending in the axial direction of the screening device or inclined thereto or can have a helical shape, thereby producing a predetermined two-dimensional bias force for the desired clamping connection of the screening device.

The T-shaped clamping element can be implemented as two separate parts, with the transverse side section contacting the screening surface of the screening element and a longitudinal side portion penetrating the spacer element. For example, a screw connection can be employed for non-positively securing and tensioning the reinforcing element. In this way, the non-positive connection can be produced by using a variety of prefabricated components and even standard parts, thereby reducing manufacturing costs.

The clamping elements of the clamping connection can be displaced in the radial direction using at least one tensioning element. The tensioning element can cooperate with the clamping element and be in the form of a screw, rivet or bolt connection adapted to radially move the clamping element.

Advantageously, the respective tensioning element can be secured to the reinforcing element after the clamping connection has been established. Different attachment methods, such as welding and the like, can be used. Optionally, a post treatment can be employed wherein, for example, the tensioning elements attached to the reinforcing device can be ground in the transition regions or finished in other ways. If necessary, partition lines produced during manufacture of the clamping connection can be smoothly fused together.

The tensioning element of the screening device extends at least partially, preferably completely, through the reinforcing element in the radial direction. A force applied to the outside of the reinforcing element establishes the clamping connection.

According to another feature of the present invention, a terminal element, for example in the shape of a ring, such as an end ring, can be releaseably connected with the reinforcing element for axially affixing the screening element on at least one axial end face of the screening element to allow positioning of the screening element in the axial direction. The terminal element can be designed as a type of adapter unit to match the characteristic of the machine. With this three-part design consisting of a screening device, a reinforcing device and terminal elements on the end face, the reinforcing device can be constructed, for example, in the form of a reinforcing jacket, regardless of how the screening device cooperates with the machine, thereby simplifying its manufacture. The terminal elements or rings perform the function of adapters and are fitted to the specific use of the machine, such as a sorter.

The releaseable connection between the terminal element (s) and reinforcing element(s) can also include pins, screws and other types of fasteners.

According to another feature of the present invention, the substantially cylindrical screening surface of the screening element can be formed of a slotted screening mat and/or a screen plate and/or sections thereof. The screening device can use conventional screening elements and components, such as slotted screening mats or curved screening plates, into which corresponding screen openings can be cut. The screening elements can also have helical screening slits or slots disposed on a screening surface formed by the screening element.

The reinforcing element can be formed as a reinforcing jacket provided with openings, also called a backup jacket. To strengthen the screening element against radial pressure loads, the reinforcing element can include additional reinforcing rings disposed on its outside surface.

According to another feature of the present invention, the terminal element can be welded to the reinforcing element while the reinforcing element is accessible from both sides and before the screening device with the spacer elements is attached, if the screening device includes at least one terminal element, for example in the form of an end ring, arranged on the axial end face(s). The screening device can then be assembled from the individual components from the inside outwardly, while the terminal element and the reinforcing element are accessible from both sides when the weld seam is formed, thereby ensuring a high-quality weld seam that can withstand high stress. In addition, the two-sided access reduces notch effects on the weld seam. The screening device with the spacer elements is installed after the connection between the terminal elements and reinforcing elements is formed. Subsequently, the screening device with the spacer elements and the reinforcing element are secured to one another by a non-positive connection. With this arrangement, the screening device can be installed and removed of as a single unit.

According to another feature of the present invention, the screening element with the spacer elements can be located relative to the terminal element in the axial direction by interposing an insertion strip, which obviates the need for an additional weld connection to affix and axially position the screening device and the spacer elements. This further simplifies the installation and removal, with the insertion strip effectively compensating tolerances in the axial direction of the screening device.

According to another feature of the present invention, a pin arrangement is employed to effectively transmit shear forces directly to the reinforcing device, in particular during operation, and prevent the screening element with the spacer elements from being displaced relative to the reinforcing element in the circumferential direction even under a severe tangential load. This arrangement reduces the stress on connections that are susceptive to shear forces, such as screw connections and weld connections. In particular, the screening element is thereby prevented from rotating relative to the reinforcing element, providing a permanent non-positive connection for the screening device while at the same time eliminating shear forces that can adversely affect the non-positive connection.

The present invention simplifies the design of the screening device by allowing those components of the screening device that are not subject to severe wear to be easily exchanged and reused cost-effectively. The screening element together with the spacer elements is secured to the reinforcing device by way of a frictionally engaging clamping connection, without permanently joining the materials, so that the screening element can be exchanged without destroying or disassembling the entire screening device. Any optional terminal elements disposed on the axial ends of the screening device are permanently connected only with the reinforcing device, and not with the screening device and the spacer elements. Hence, the screening to elements can be replaced, for example, by partially disassembling the screening device, while leaving the original connection between terminal elements and reinforcing element in place.

BRIEF DESCRIPTION OF THE DRAWING

Other features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
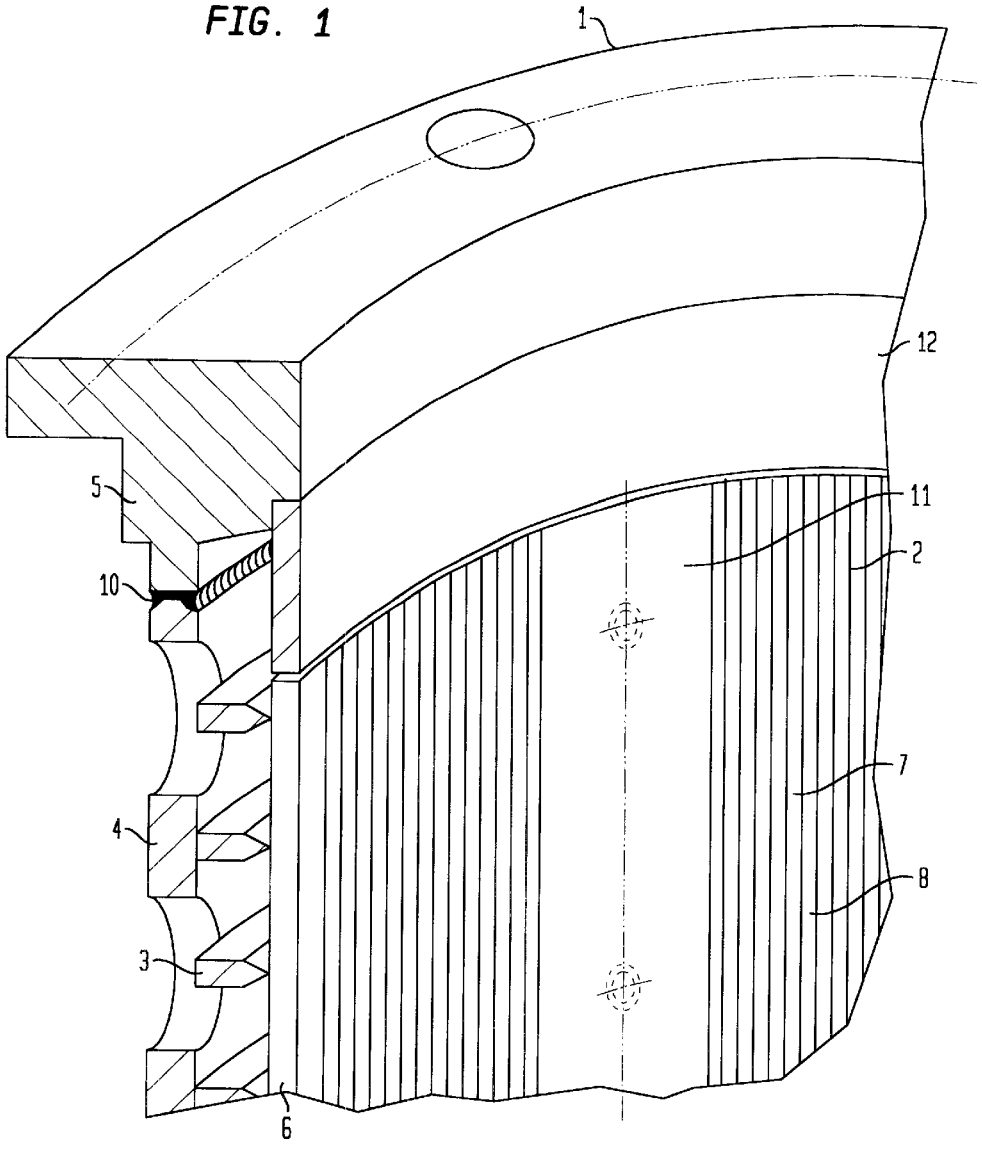
FIG. 1 is a perspective partial view of a screening device according to the invention.

Throughout all the Figures, same or corresponding elements are generally indicated by same reference numerals. Embodiments and modifications thereof as described in the figures are to be understood only as exemplary and in no way as limiting the scope of the invention.

Turning now to the drawing, and more particularly to FIG. 1, there is shown a perspective partial view of a screening device according to the invention, generally designated by reference numeral 1 and including a screening element 2, spacer elements 3, a reinforcing element 4, and an axial terminal element 5 disposed on an end face. The screening element 2 includes rod-shaped screening units 6, also referred to as screening rods. The screening rods are arranged to be mutually parallel and spaced-apart and are parallel to the axis of the screening device 1. Screening slits 7 and/or slots 7 are formed between two respective adjacent rod-shaped screening units 6. To maintain a predetermined arrangement of the rod-shaped screening units 6, the units 6 are suitably secured on the spacer elements 3, which are preferably spaced apart in the axial direction along the circumference of the screening element 2. Advantageously, the spacer elements 3 are in the form of rings. The rod-shaped screening units 6 in conjunction with the spacer elements 3 form the screening element 2, wherein the inside surface 8 of the screening device 1 forms an essentially cylindrical screening surface that includes screening slits and/or screening slots 7.

In the embodiment of FIG. 1, the terminal element 5 in the form of an end ring and disposed on the end face is connected with the reinforcing element 4 through a weld connection 10. The reinforcing element 4 is advantageously implemented as a reinforcing jacket with corresponding through openings (not shown). The location of the weld connection 10 is accessible from both sides, so that a high-quality weld seam can be reliably provided, for example, in the form of a double fillet weld 10, as illustrated. The screening device 1 is assembled and constructed from the inside out.

The screening element 2 is affixed to the reinforcing element 4 by way of a frictionally engaging clamping connection so that in the assembled state the screening element cannot rotate relative to the reinforcing element 4. In the illustrated example, the clamping connection is implemented as a wedge connection 11 which will be described in greater detail below. In the illustrated example, the wedge connection 11 is a wedge rail extending in the axial direction of the screening device 1. An insertion strip 12 is provided between the terminal element 5 and the associated screening element 2 to facilitate axially positioning the screening element 2 and its rod-shaped screening units 6, with the insertion strip in the assembled state covering the weld connection 10 towards the inside of the screening device 1.

The clamping connection in form of the wedge connection 11 frictionally and releaseably connects the screening element 2 together with the spacer elements 3 to the reinforcing unit 4, which has the form of a reinforcing jacket or backup jacket. The spacer elements 3 provide a radial clearance between the screening surface of the screening element 2 and the reinforcing element 4. The clamping action and frictional engagement secure the screening element non-rotatably on the reinforcing element 4.

When the screening element 2 is worn out in the course of routine operations or if the wear characteristics cause the performance to deteriorate, the frictionally engaging clamping connection of the screening device 1 allows the screening element 2 to be removed together with the spacer elements 3 as a single unit and replaced by a new unit. For this purpose, the clamping connection, for example the wedge connection 11, is released and the screening element can be removed without destroying or even damaging the reinforcing device 4. A new screening element 2 is then installed and non-rotatably secured with the help of the frictionally engaging clamping connection, for example the wedge connection 11, together with the reinforcing element 4 and the optionally provided terminal element 5, whereafter the screening device 1 is returned to the intended service in a corresponding machine, such as a sorter (not shown).

Additional embodiments of frictionally engaging clamping connections will be described schematically with reference to FIGS. 2 to 10.

Figure 2:
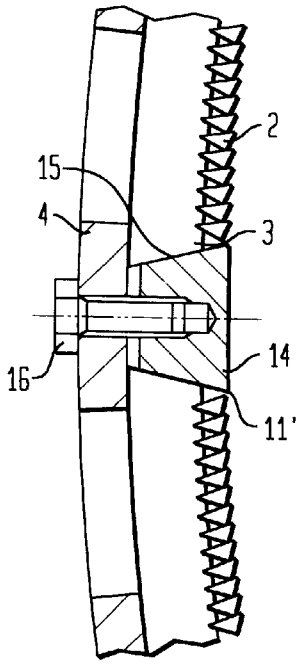
FIG. 2 is a schematic partial cross-sectional view of a clamping connection formed as a frictionally engaging connection with a wedge element that cooperates in a radial tensioning direction directly with a spacer element.

FIG. 2 shows a wedge connection 11' having one or several wedge elements 14 which cooperate in a radial tensioning direction directly with the spacer element 3 of the screening element 2, with complementary wedge-shaped openings 15 being provided in the spacer elements 3. The wedge element 14 is moved in a radial tensioning direction, in FIG. 2 towards the left, using a screw 16, whereby the screening element 2 with the spacer elements 3 is connected through frictional engagement with the reinforcing element 4 by clamps.

Although not shown in detail, several wedge elements 14 which form clamping elements, can be arranged in the axial direction of the screening device 1, preferably extending over several surface lines distributed in the circumferential direction.

Figure 3:
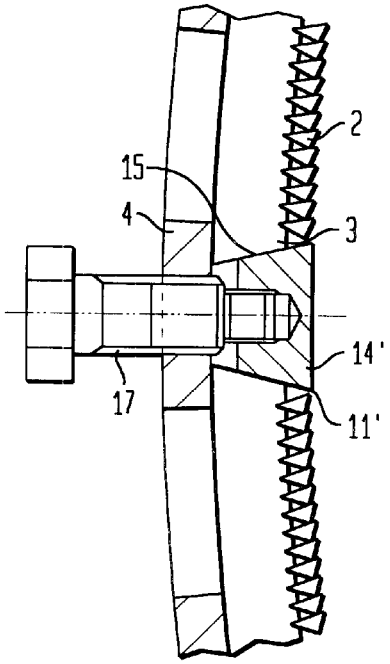
FIG. 3 is a schematic partial cross-sectional view depicting a modified embodiment of a clamping connection with a wedge element of FIG. 2, wherein the tensioning element is a stepped screw.

FIG. 3 shows a frictionally engaging clamping connection in the form of a wedge connection 11". Unlike FIG. 2, the tensioning element is here formed by a stepped screw 17 which engages in a corresponding threaded bore of the respective wedge element 14'. After the clamps are tensioned through frictional engagement, secured the screening elements 2 to the reinforcement element 4, the stepped screw 17 can be affixed to the reinforcing device 4, for example, by severing the head of the stepped screw 17 and grinding the surface and optionally filling the space between the stepped screw 17 and the reinforcing device 4 with a suitable material. As shown in FIG. 3, the clamping connection between the screening element 2 and the reinforcing element 4 is established by the tensioning device which is oriented in the radial direction.

Figure 4A:
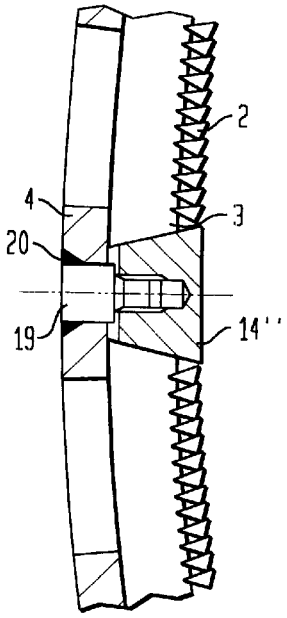
FIGS. 4*a*, 4*b*, show each a schematic partial cross-sectional view of a bolt arrangement for a tensioning element of a clamping connection.
Figure 4B:
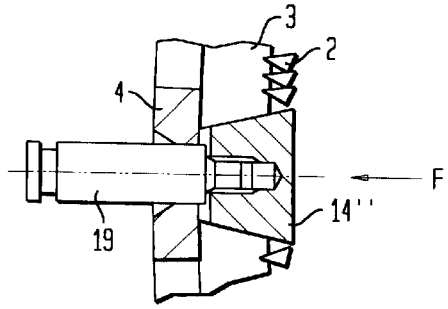

Referring now to FIGS. 4*a* and 4*b*, the tensioning element of the clamping connection is a bolt 19 which cooperates with a wedge element 14" in a similar manner as depicted in FIG. 3. After applying a tension force in the direction of the arrow F, the bolt 19 is severed and secured to the reinforcing device 4, for example, through a weld connection 20. The protruding portion of the bolt 19 can then be cut off and optionally ground.

Figure 5A:
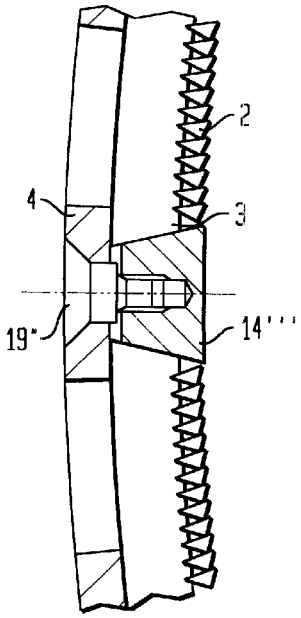
FIGS. 5*a*, 5*b*, show each a schematic partial cross-sectional view of a rivet arrangement for a tensioning element of a clamping connection.
Figure 5B:
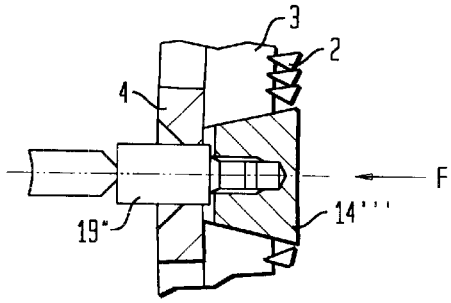

FIGS. 5*a* and 5*b* depict another embodiment of a clamping connection using clamping elements 14'". This clamping connection here includes a bolt 19', which unlike the embodiment of FIGS. 4*a* and 4*b*, is not tensioned by a tensile force, but instead by a pressure force. After the non-positive connection is established, the bolt 19' forming the tensioning element can be secured to the reinforcing element 4 in the same or a similar manner as depicted in FIGS. 4*a* and 4*b*.

Figure 6:
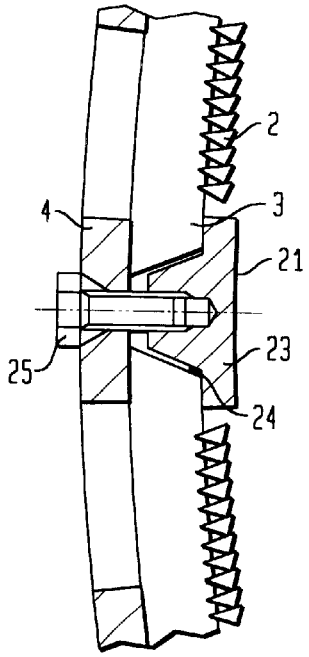
FIG. 6 is a schematic partial cross-sectional view depicting a embodiment of a T-shaped clamping element, wherein the transverse side of the "T" makes two-dimensional contact with the screening element when the clamping connection is formed.

FIG. 6 schematically depicts a cross-sectional view of a clamping element 21 with a T-shaped cross-section.

Figure 8A:
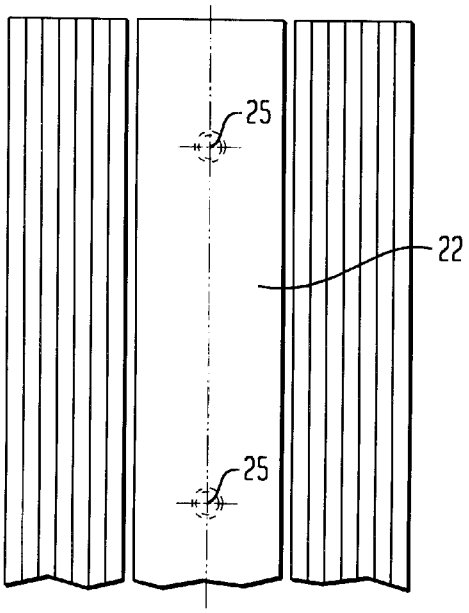
FIGS. 8*a*, 8*b*, show each schematically an embodiment wherein a T-shaped clamping element is formed as a rail extending in the axial direction of the screening device or at an angle thereto.
Figure 8B:
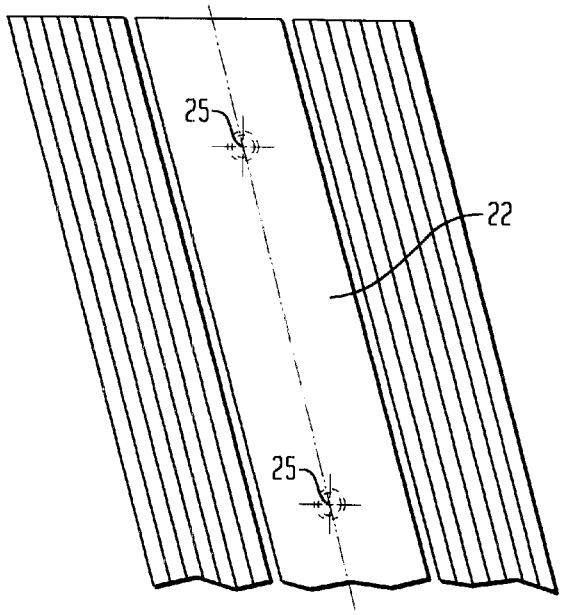

As shown in FIGS. 8*a* and 8*b*, the T-shaped clamping element 21 can be formed as a rail 22 extending in the axial direction of the screening device 1 or at an angle thereto. The transverse side 23 of the clamping element 21 contacts the screening surface of the screening element 2. Following in the axial direction is a tensioning wedge 24, of the type depicted for example in FIG. 6, which can cooperate with a complementary wedge surface of a corresponding wedge-shaped opening 15 provided in the spacer element 3 of the screening element 2. Like the afore-described embodiments, the tensioning element can be implemented as a screw 25. The shank of the screw 25 extends with clearance through a corresponding opening in the reinforcing element 4. After forming the frictionally engaging clamping connection between the screening element 2 and the reinforcing element 4, the tensioning element, e.g., the screw 25, can be secured to the reinforcing element 4, for example by joining the two elements with a suitable material.

Figure 7:
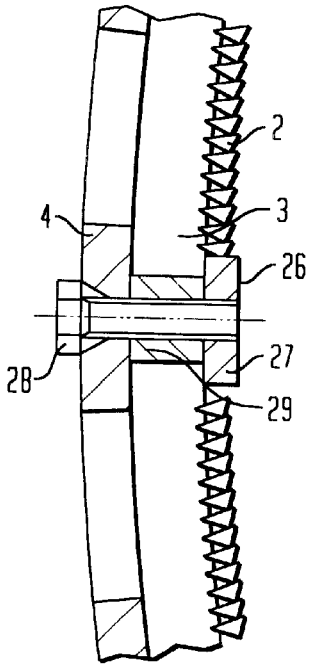
FIG. 7 is a schematic partial cross-sectional view depicting another embodiment of a clamping connection with a two-part clamping element.

FIG. 7 shows a two-part embodiment of a clamping connection between the screening element 2 and the reinforcing element 4. The two-part clamping element 26 includes a first section 27 in the form of a cover strip which contacts the screening surface 9 of the screening element 2. This first section 27 has a thread adapted to receive a screw 28 that forms a tensioning element. A spreading strip 29 with a through bore is arranged between the inside of the reinforcing device 4 and the corresponding inside of the first section 27 forming the cover strip. When the screw 28 is tightened, the spreading strip 29 in cooperation with the first section 27 is spread apart, forming the clamping connection that frictionally engages the screening element 2 and the spacer elements 3 with the reinforcing element 4.

Figure 9:
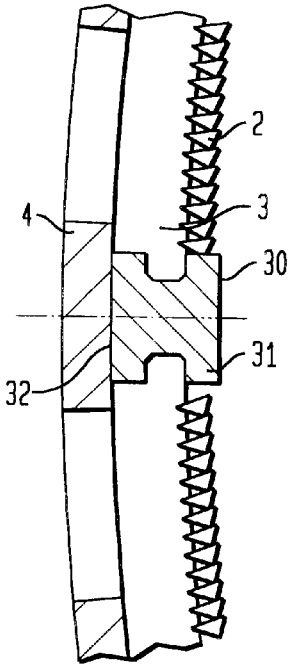
FIG. 9 is a schematic partial cross-sectional view depicting an embodiment of a non-positive connection between a strip having an I-shaped cross section.

In the embodiment of FIG. 9, a clamping element 30 has an I-shaped cross-section. The first transverse side 31 contacts the screening surface 9 of the screening element 2. The other transverse side 32 of the clamping element 30 contacts the corresponding spacer element 3. The I-shaped clamping element 30 is preferably formed as a strip and extends in the axial direction of the screening device 1 or at an angle thereto. The clamping element 30 is advantageously inserted from an axial side of the screening device. The clamping element 30 cooperates with the screening element 2 to spread the screening element 2 apart in the circumferential direction and clamp the screening element 2 by friction to the reinforcing element 4.

Figure 10:
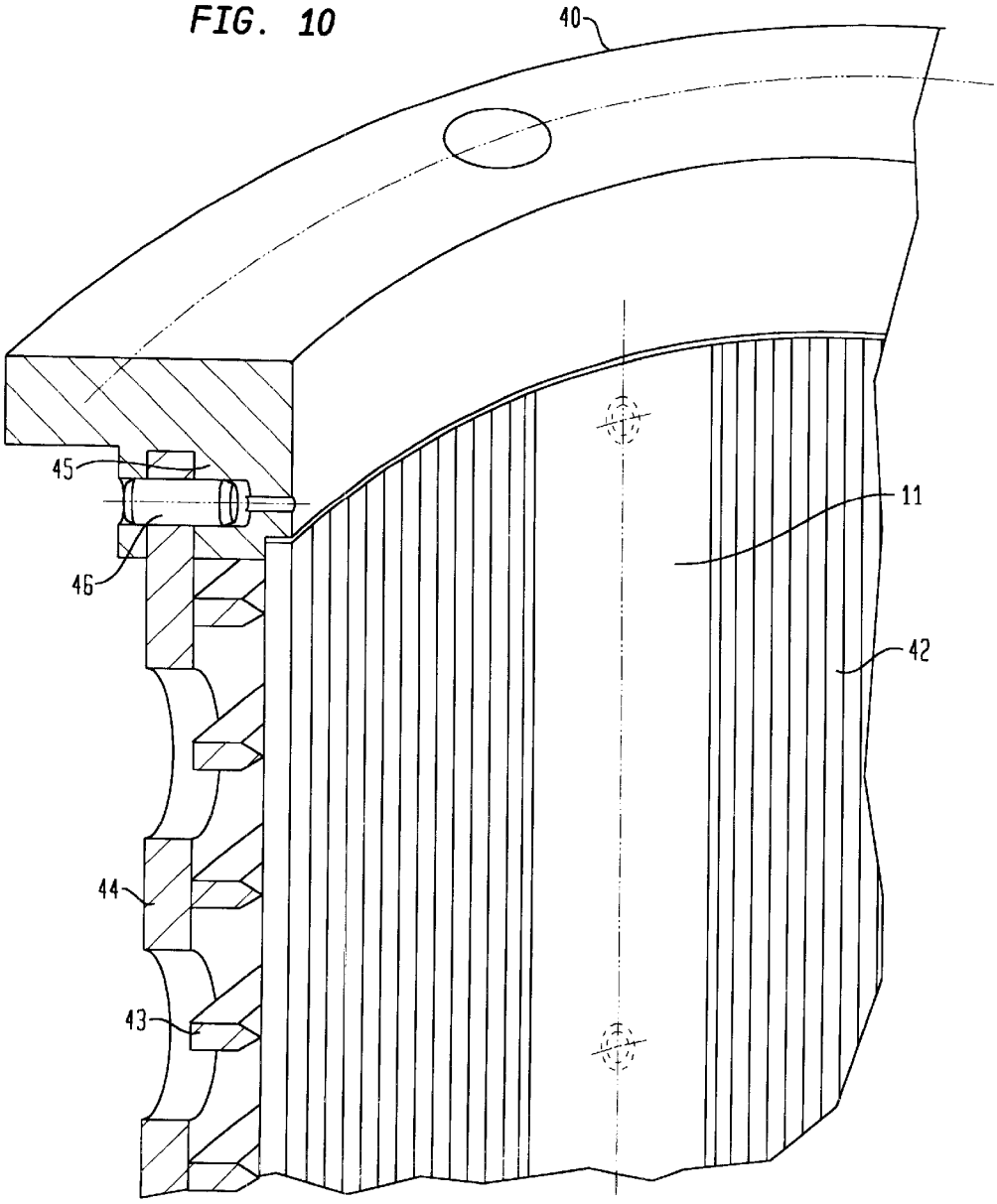
FIG. 10 is a perspective partial view of a screening device with a releaseable terminal element provided on one axial end.

Referring now to FIG. 10, a screening device 40 includes a screening element 42, spacer elements 43 and a reinforcing element 44. On at least one axial end face of the screening device 40, a terminal element 45 which has for example an annular shape in the form of an end ring, is releaseably connected with the reinforcing element 44. The releaseable connection of FIG. 10 is implemented using pins 46, which are preferably evenly spaced along the circumference of the terminal element 45. In addition, the surface of the terminal element 45 facing the screening element 42 is shaped such that the terminal element 45 simultaneously positions the screening element 42 in the axial direction. Unlike with the embodiment of FIG. 1, no insertion strip 12 is required, simplifying disassembly of the screening device 40 for changing the screening element 42. The screening element 42 together with the spacer elements 43 can be removed as a single unit or along identical circumferential sections after the releaseable connection formed by the pins 46 between the terminal element 45 and the reinforcing device 44 is released.

Figure 11:
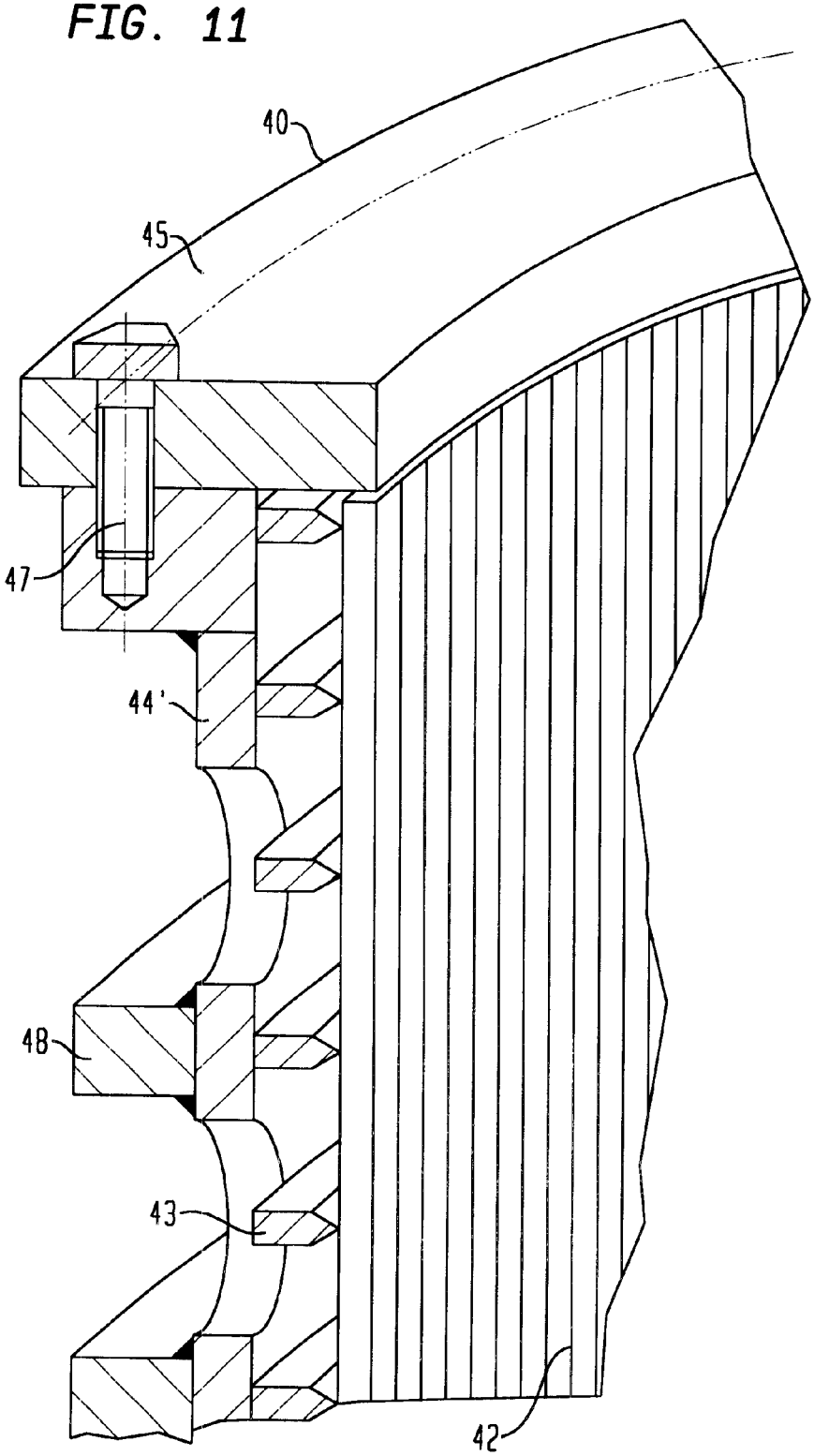
FIG. 11 is a view similar to that of FIG. 10 of a releaseable connection of a terminal element disposed on an end face on the reinforcing device.

In another embodiment of a screening device 40' depicted in FIG. 11, unlike the screening device 40 of FIG. 10, the releaseable connection between terminal element 45' and reinforcing element 44' is formed by screws 47 extending in the axial direction. The screws 47 are preferably arranged in the terminal element 45' in evenly spaced angular increments and engage in corresponding threaded openings provided in a portion of the reinforcing element 44'. The terminal element 45' is designed so that the screening element 42 can be easily positioned in the axial direction.

Although not shown in detail, additional terminal elements 45, 45' can be provided on the end face and releaseably connected with the reinforcing element 44, 44'. A combination of releaseable and fixed connections between terminal element 45, 45' and reinforcing device 44,44' is also feasible, and it suffices that at least one of the terminal element 45, 45' is releaseably connected on the end face with the reinforcing element 44, 44'.

The frictionally engaging clamping connections between screening element 42 and spacer element 43 and the associated reinforcing element 44, 44' can be implemented as described above with reference to the other embodiments.

Figure 12A:
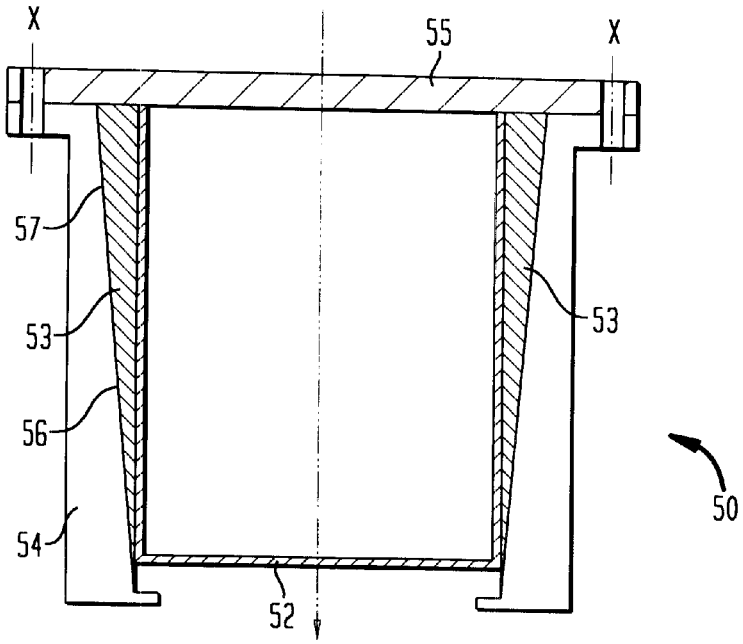
FIG. 12A is a schematic cross-sectional view of an alternative embodiment of a frictionally engaging clamping connection of a screening device and a reinforcing device.
Figure 12B:
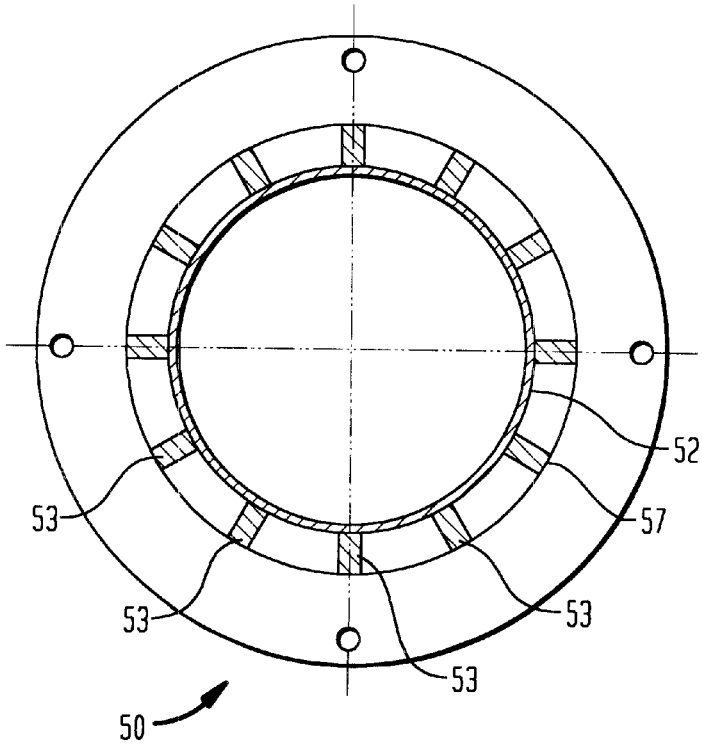
FIG. 12B is a schematic top view of the screening device of FIG. 12A.

FIGS. 12A and 12B show a cross-sectional view and a top view, respectively, of an alternative embodiment of a frictionally engaging clamping connection for a screening device 50. The clamping connection has a tapered fit. Like the afore-described screening devices, the screening device 50 also includes a screening element 52 implemented as a screen insert, spacer elements 53, a reinforcing device 54 and a terminal element 55 that is preferably releaseably connected with the reinforcing element 54. The spacer elements 53 of the screening element 52 form a seating surface 56 having a conical shape in the axial direction.

The reinforcing element 54 has a matching conical seating surface contour 57. The conical seating surfaces 56, 57 form a frictionally engaging clamping connection with the reinforcing element 54 when the screening element 52, i.e., the screen insert, is inserted and secure the screening element 52. The reinforcing element 54 is thereby prevented from rotating relative to the screening element 52 during operation of the machine. As illustrated schematically, the terminal element 55 can be releaseably connected to the reinforcing element 54, similar to the embodiment depicted in FIG. 11.

Figure 13:
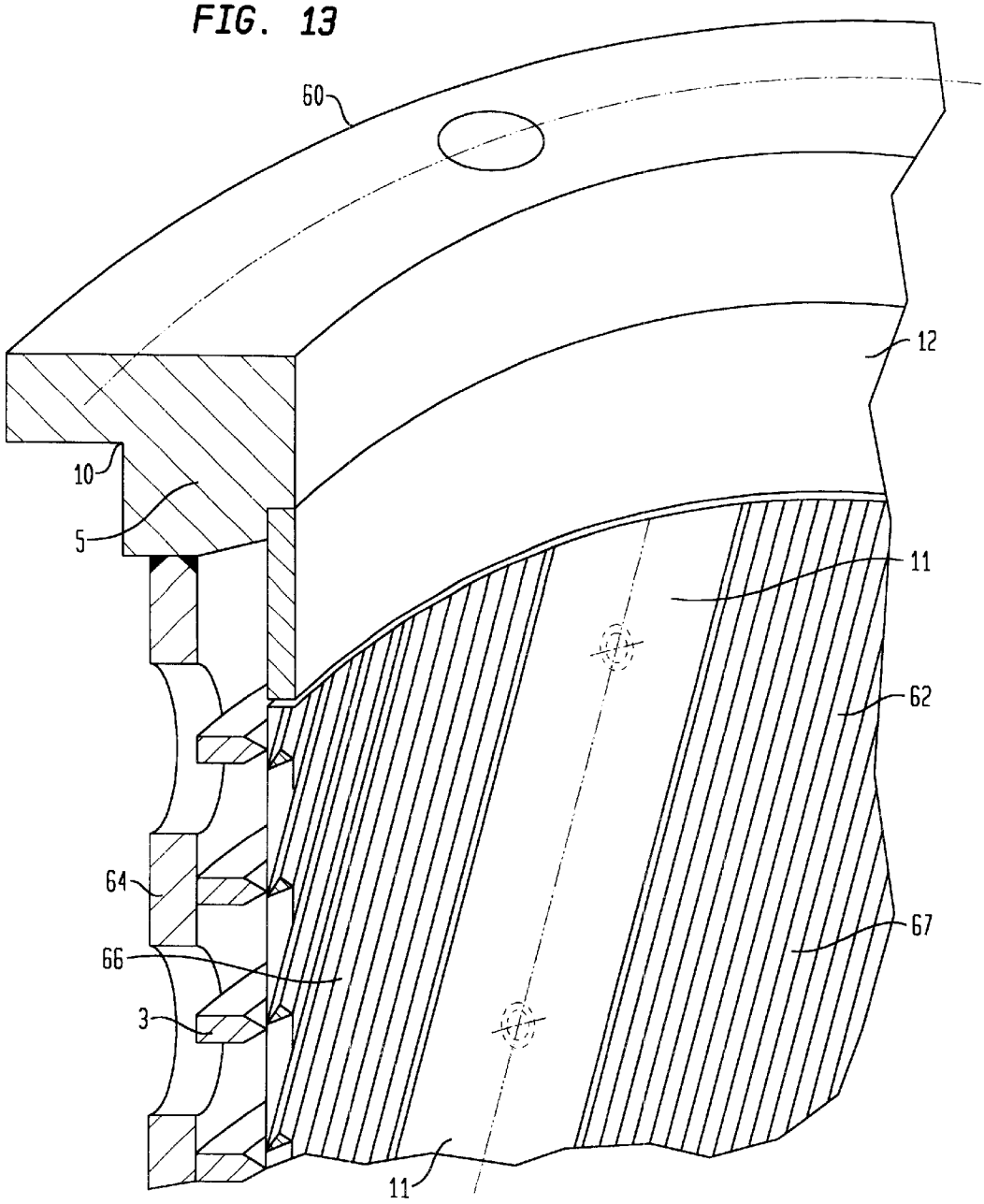
FIG. 13 is a perspective schematic partial view of a screening device with a helical orientation of screening slots arranged on the screening surface of the screening element.

FIG. 13 shows another embodiment of a screening device 60 wherein, unlike the embodiment of FIG. 1, the rod-shaped screening units 66 form helical screening slots 67. The screening element 62 of the screening device 60 can be connected with the reinforcing element 64 through a frictionally engaging clamping connection which can be similar or identical to the clamping connections of the embodiments described above.

Although the screening elements 2, 42, 52 and 62 in the afore-described embodiments are illustrated as slotted screening mats and/or sections thereof, which include rod-shaped screening units or screening rods 6 or 66, the screening elements 2, 42, 52 or 62 can also be formed by a screen plate and/or sections thereof (not shown in detail).

While the invention has been disclosed in connection with the preferred embodiments shown and described in detail, various modifications and improvements thereon will become readily apparent to those skilled in the art. For example, as shown in FIG. 11, reinforcing rings 48 can optionally be provided on the outer circumference of the reinforcing element 4, 44, 44', 54 or 64. However, the screening elements 2, 42, 52 or 62 of the screening device 1, 40, 40', 50 or 60 should be designed as a replaceable unit, by releaseably connecting the respective screening device 1, 40, 40', 50 or 60 with the respective associated reinforcing element 4, 44, 44', 54 or 64 through a frictionally engaging clamping connection. Accordingly, the spirit and scope of the present invention is to be limited only by the following claims.

What is claimed is:

1. A screening device comprising:

a screening element having a screening surface and formed substantially as a cylinder having a cylindrical axis, said screening element being so configured as to be removable as a unit;

a reinforcing element supporting the screening element;

a plurality of spacer element formed along an outside surface of the screening element providing a radial clearance between the screening element and the reinforcing element;

a clamping connection including a conical seating surface formed by the spacer elements and the reinforcing element having a matching conical seating surface for non-positively and releaseably securing the screening element to the reinforcing element through frictional engagement with the spacer elements;

at least one terminal element disposed on at least one end face of the screening element, and said at least one terminal element disposed on the reinforcing element so as to be accessible from both end faces of the screening element, before the screening element with the spacer elements is placed on the reinforcing element; and the at least one terminal element is formed by an annular end ring releasably connected to an upper end face of the reinforcing element by means of a screw connection.

2. A screening device comprising:

a screening element having a screening surface and formed substantially as a cylinder having a cylindrical axis, said screening element being so configured as to be removable as a unit;

a reinforcing element supporting the screening element;

a plurality of spacer element providing a radial clearance between the screening element and the reinforcing element;

a clamping connection including at least one clamping element for forming the clamping connection is moveable radially towards the reinforcing element, the at least one clamping element non-positively and releaseably securing the screening element to the reinforcing element through frictional engagement;

wherein the at least one clamping element is formed as a T-shaped rail having a transverse side which rests on the screening surface of the screening element and extends at an angle relative to the cylindrical axis of the screening element.

3. The screening device of claim 2, and further comprising a terminal element, disposed at least at one end face of the screening element and connected to the reinforcing element, for positioning the screening element in axial direction.

4. The screening device according to claim 2, wherein the terminal element is releaseably connected to the reinforcing element.

5. The screening device of claim 4, wherein the releaseable connection is implemented as a pin connection.

6. The screening device of claim 4, wherein the releaseable connection is implemented as a screw connection.

7. The screening device of claim 2, wherein the at least one clamping element is moveable in a radical direction by at least one tensioning element selected from the group consisting of screw, rivet and bolt.

8. The screening device of claim 7, wherein the at least one tensioning element is secureable to the reinforcing element after implementation of the clamping connection.

9. The screening device of claim 8, wherein the at least one tensioning element penetrates the reinforcing element in a radial direction.

10. The screening device of claim 2, wherein the at least one T-shaped clamping element is formed in two parts.

11. The screening device of claim 10, wherein the two parts of the at least one T-shaped clamping element includes a transverse side portion bearing upon the screening surface and a longitude side portion that extends through the spacer elements.

12. The screening device according to claim 2, wherein the screening element is formed from a material selected from the group consisting of slotted screen mat, portions of a slotted screen mat, screen plate, and portions of a screen plate.

13. The screening device of claim 2, wherein the screening element has helical screening slots disposed on the screening surface.

14. The screening device of claim 2, wherein the reinforcing element is formed as a reinforcing jacket having through-openings.

15. The screening device of claim 2, and further comprising a pin connection that transmits shear forces for preventing a relative displacement between the screening element and the spacer elements relative to the reinforcing element in a circumferential direction.

16. A screening device comprising:

a screening element having a screening surface and formed substantially as a cylinder having a cylindrical axis, said screening element being so configured as to be removable as a unit;

a reinforcing element supporting the screening element;

a plurality of spacer element providing a radial clearance between the screening element and the reinforcing element;

a clamping connection including at least one clamping element for forming the clamping connection which is moveable radially towards the reinforcing element, the at least one clamping element non-positively and releaseably securing the screening element to the reinforcing element through frictional engagement;

wherein the at least one clamping element is formed as a T-shaped rail having a transverse side which rests on the screening surface of the screening element and extends in a helical shape.

17. The screening device of claim 5, and further comprising a terminal element, disposed at least at one end face of the screening element and connected to the reinforcing element, for positioning the screening element in axial direction.

18. The screening device according to claim 17, wherein the terminal element is releaseably connected to the reinforcing element.

19. The screening device of claim 18, wherein the releaseable connection is implemented as a pin connection.

20. The screening device of claim 18, wherein the releaseable connection is implemented as a screw connection.

21. The screening device of claim 16, wherein the at least one clamping element is moveable in a radial direction by at least one tensioning element selected from the group consisting of screw, rivet and bolt.

22. The screening device of claim 21, wherein the at least one tensioning element is securable to the reinforcing element after implementation of the clamping connection.

23. The screening device of claim 22, wherein the at least one tensioning element penetrates the reinforcing element in a radial direction.

24. The screening device of claim 16, wherein the at least one T-shaped clamping element is formed in two parts.

25. The screening device of claim 24, herein the at least one T-shaped clamping element includes a transverse side portion bearing upon the screening surface and a longitudinal side portion that extends through the spacer elements.

26. The screening device of claim 16, wherein the at least one clamping element extends through the screening element and is securable to the reinforcing element.

27. The screening device according to claim 16, wherein the screening element is formed from a material selected from the group consisting of slotted screen mat, portions of a slotted screen mat, screen plate, and portions of a screen plate.

28. The screening device of claim 16, wherein the screening element has helical screening slots disposed on the screening surface.

29. The screening device of claim 16, wherein the reinforcing element is formed as a reinforcing jacket having through-openings.

30. The screening device of claim 16, and further comprising a pin connection that transmits shear forces for preventing a relative displacement between the screening element and the spacer elements relative to the reinforcing element in a circumferential direction.

31. A screening device comprising:

a screening element having a screening surface and formed substantially as a cylinder having a cylindrical axis, said screening element being so configured as to be removable as a unit;

a reinforcing element supporting the screening element and having a conical seating surface;

a plurality of spacer elements providing a radical clearance between the screening element and the reinforcing element, said spacer elements forming a conical seat seating surface extending substantially in the direction of the cylindrical axis and the conical seating surface of the spacer elements and the reinforcing element forming a frictionally engaging clamping connection which prevents rotation of the reinforcing element relative to the screening element, and further comprising a terminal element disposed on at lease one end face of the screening element and releasably connected to the reinforcing element for positioning the screening element in an axial direction, wherein the terminal element is formed by an annular end ring element releasably connected to an upper end face of the reinforcing element by means of a screw connection.

32. The screening device according to claim 31, wherein the screening element is formed from a material selected from the group consisting of slotted screen mat, portions of a slotted screen mat, screen plate, and portions of a screen plate.

33. The screening device of claim 31, wherein the screening element has helical screening slots disposed on the screening surface.

34. The screening device of claim 31, herein the reinforcing element is formed as a reinforcing jacket having through-openings.

* * * * *